United States Patent [19]

Droller et al.

[11] Patent Number: 4,666,419

[45] Date of Patent: May 19, 1987

[54] FIGURE TOY WITH GRIPPING LEGS ASSEMBLY

[75] Inventors: Richard Droller, Prospect, Conn.; Brian Fontaine, Southbridge, Mass.

[73] Assignee: Coleco Industries, Inc., West Hartford, Conn.

[21] Appl. No.: 826,851

[22] Filed: Feb. 6, 1986

[51] Int. Cl.[4] ..... A63H 3/20

[52] U.S. Cl. ..... 446/330; 446/390

[58] Field of Search ..... 446/359, 330, 365, 317, 446/376, 379, 352, 353, 356, 390

[56] References Cited

U.S. PATENT DOCUMENTS

| | | | |
|---|---|---|---|
| 188,841 | 3/1877 | Baxter . | |
| 699,780 | 5/1902 | Woerner . | |
| 2,514,356 | 7/1950 | Borresen | 446/365 |
| 2,614,365 | 10/1952 | Musselwhite et al. . | |
| 3,053,008 | 9/1962 | Pelunis . | |
| 3,094,331 | 6/1963 | Greene | 446/330 X |
| 3,564,764 | 2/1971 | Crosman et al. | 446/359 |
| 4,056,896 | 11/1977 | Karasawa . | |
| 4,244,138 | 1/1981 | Holahan et al. . | |
| 4,301,615 | 11/1981 | Ikeda . | |
| 4,307,533 | 12/1981 | Sims et al. . | |
| 4,575,349 | 3/1986 | Piazza et al. | 446/330 |
| 4,579,541 | 4/1986 | Kulesza et al. | 446/359 |
| 4,579,543 | 4/1986 | Renger et al. | 446/379 X |

FOREIGN PATENT DOCUMENTS

| | | | |
|---|---|---|---|
| 1601180 | 10/1981 | United Kingdom | 446/330 |

*Primary Examiner*—Mickey Yu

[57] ABSTRACT

A toy creature figure has pivotably mounted simulated leg elements which can be operated manually to effect a gripping action. The subassembly of pivot pieces and actuating lever provided is effective to readily operate the leg members, and manufacture of the toy is relatively facile and inexpensive.

12 Claims, 7 Drawing Figures

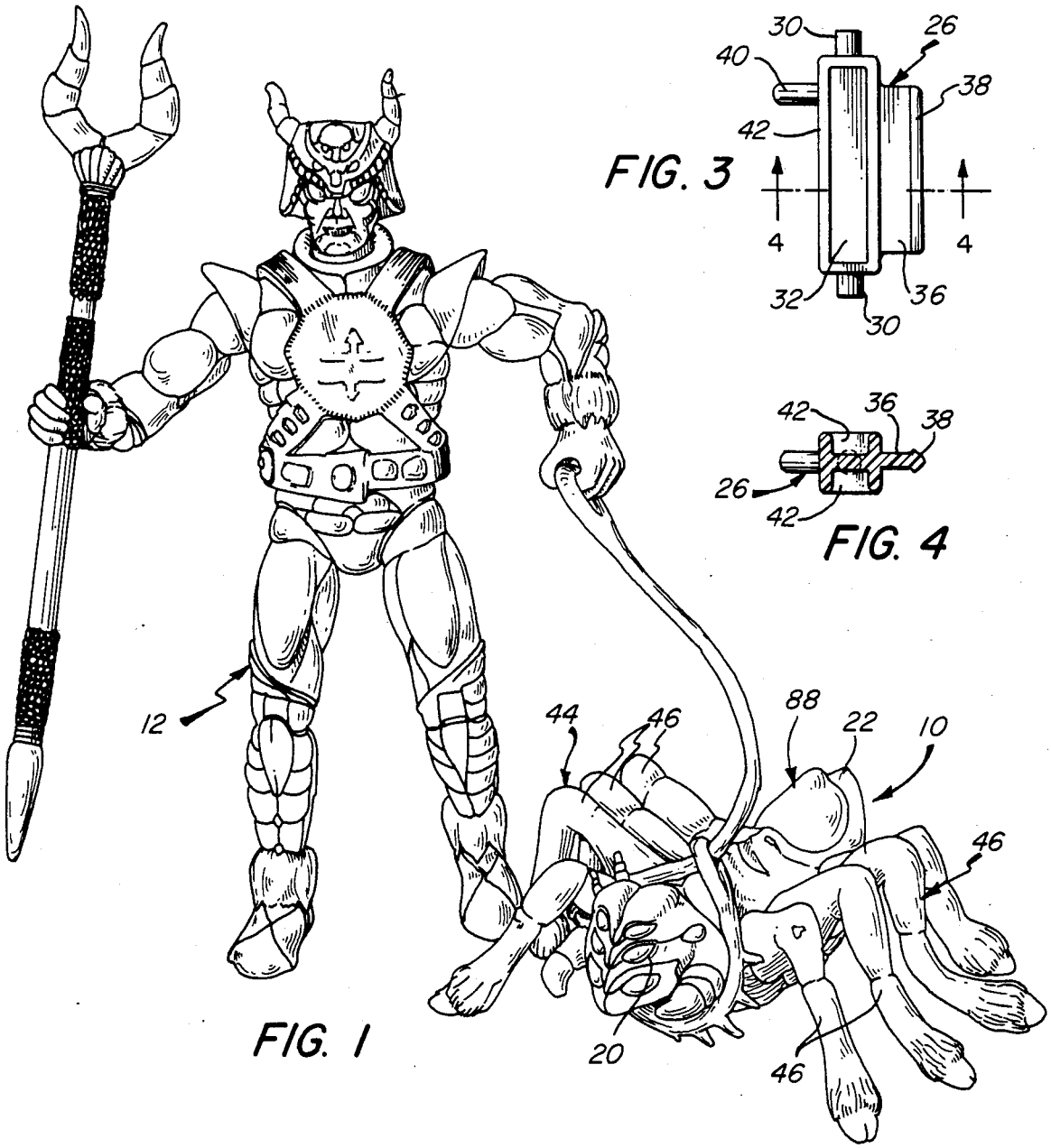
FIG. 1
FIG. 3
FIG. 4
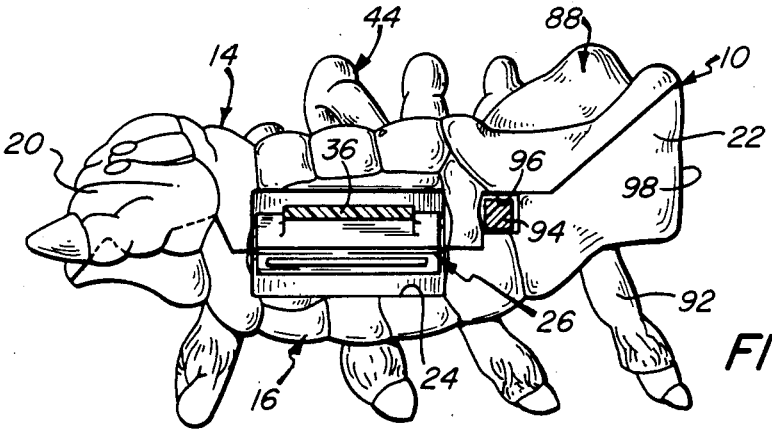
FIG. 2

FIG. 5
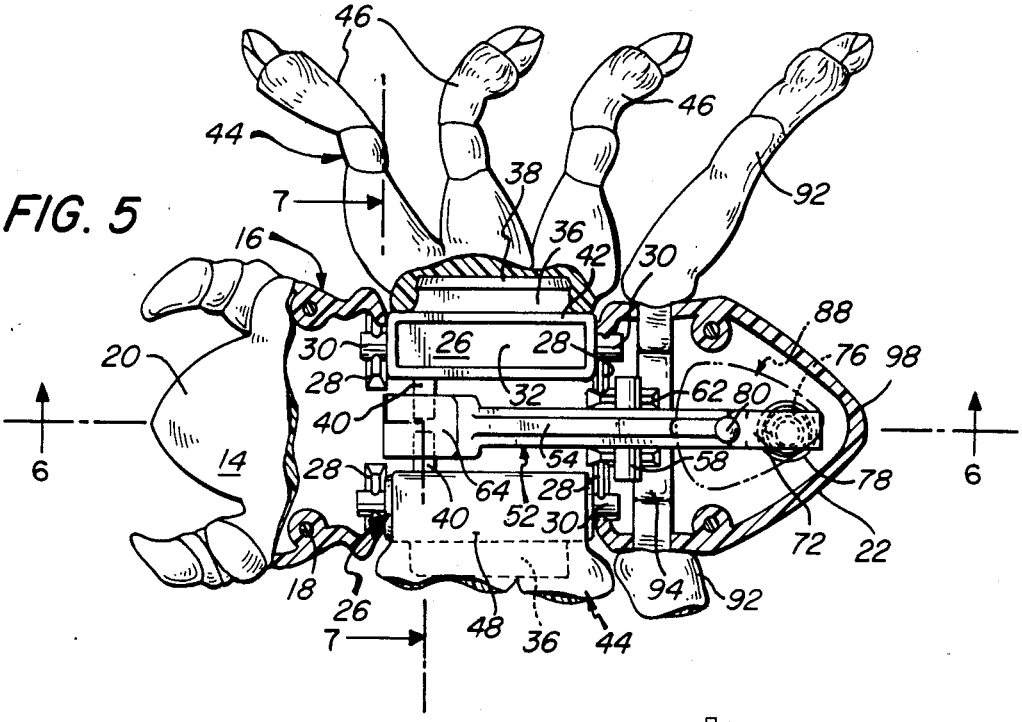
FIG. 6
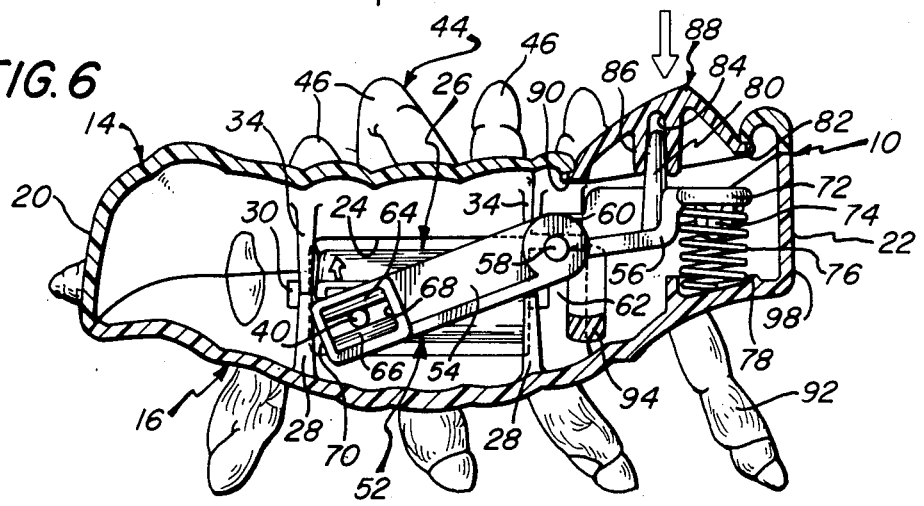
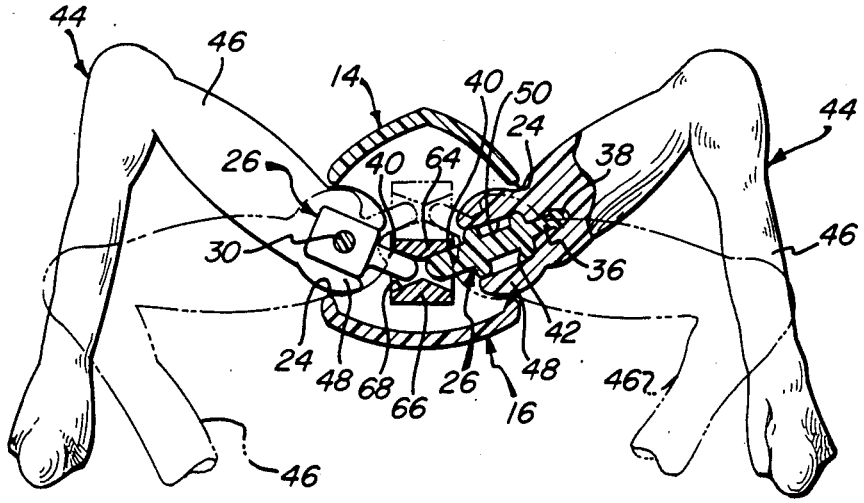
FIG. 7

FIGURE TOY WITH GRIPPING LEGS ASSEMBLY

BACKGROUND OF THE INVENTION

An ongoing demand exists for action toys having novel features. It is of course important that any such toy be effective in its appearance and operation, while also being durable and relatively facile and inexpensive to manufacture. The prior art discloses numerous forms of action toys in which various parts can be moved in different ways; typical are the following United States patents:

Baxter U.S. Pat. No. 188,841 discloses a toy in the form of a simulated tortoise, wherein each of two pieces includes a pair of legs, the pieces being pivotable within the body and actuated by a spring-operated propelling wheel.

Woerner U.S. Pat. No. 699,780 shows a foot rest in the form of a turtle, wherein a lazy-tongs arrangement serves to actuate simulated legs.

Musselwhite et al U.S. Pat. No. 2,614,365 and Pelunis U.S. Pat. No. 3,053,008 both disclose dolls in which spring-mounted arms may be actuated in an embracing movement.

In U.S. Pat. No. 4,056,896, Karasawa discloses a toy bird having wings that "flutter"; they are actuated by the offset shaft of a sheave, which passes through channel openings in tangs on members to which the wings are attached.

Holahan et al U.S. Pat. No. 4,244,138 describes an animated bird in which a trigger-like lever, pivotably mounted upon the body, is operated to simulate flapping of wing portions.

Ikeda U.S. Pat. No. 4,301,615 provides a mechanical turtle having legs and a head that extend and retract, and a tail that spins.

In the toy insect of Sims et al U.S. Pat. No. 4,307,533, four wings are rotatably mounted upon pins attached to hinged mounting plates. The plates are acted upon by a lever to elevate the wings against the force of gravity.

It is an object of the present invention to provide a novel toy creature figure having a unique action feature in the form of matched appendages that move toward and away from one another in a gripping motion.

It is also an object of the invention to provide such a toy figure wherein a unique mechanism is provided for operating the appendages.

Another object of the invention is to provide such a toy having fixed appendages which cooperate with a tail portion to provide means for stably supporting the toy in an upright position.

Additional objects of the invention are to provide such a toy creature figure which is effective in its appearance and operation, is durable, and is relatively facile and inexpensive to manufacture.

THE SUMMARY OF THE INVENTION

It has now been found that certain of the foregoing and related objects of the invention are readily attained in a figure toy comprised of a generally hollow body having back, front and lateral portions with lateral openings formed therethrough; a matched pair of limb members, each having a mounting portion with a recess formed therein and at least one appendage extending therefrom; and a pair of pivot pieces. The pivot pieces are mounted within the body adjacent the lateral openings for pivotal movement about parallel axes, and each of them has an outer portion which is engaged within the recess of one of the limb members, thereby mounting the limb members with the appendages thereof extending in the same general direction. An actuating member is mounted within the body for pivotal movement about an axis generally transverse to the parallel axes of the pivot pieces, and the actuating member has a portion disposed generally therebetween. Interengaging means transmits pivotal movement of the actuating member to the pivot pieces to effect pivotal movement thereof, which means comprises slot formations on either the actuating member or on both of the pivot pieces, and cooperating pin elements on the other (i.e., the non-slotted) part or parts, which are disposed within the slot formations. The body has means thereon for enabling manual operation of the actuating member, to simultaneously move the limb members to effect either a closing or an opening action of the appendages.

In the preferred embodiments, the actuating member will comprise a lever having a coupling arm which extends between the pivot pieces, and which has slot formations thereon spaced from the lever fulcrum. The pin elements will be disposed on the pivot pieces and will project toward one another into the slot formations, with the mounting portions of each of the pieces projecting outwardly therefrom. The coupling arm may have upper and lower rectilinear elements of V-shaped, apically confronting cross sectional configuration, to provide inwardly tapered slot formations extending along the opposite sides thereof, and the actuating lever will usually have an operating arm extending from the fulcrum in a generally opposite direction to the coupling arm.

The toy will desirably include a push-button member that is accessible for finger contact and is operatively connected to the operating arm of the lever, to enable the manual operation of the limb members. It will normally have a coil spring or equivalent means, usually acting upon the actuating member, for biasing the appendages toward either an open or closed relationship to one another; in the preferred embodiments, the biasing means will act to bias the appendages toward their open position, and operation of the actuating member will effect a closing action thereof.

Most desirably, each of the limb members will have a plurality of leg-like appendages which are symmetrically disposed with respect to the body. In such a figure, the mounting portions and the recesses thereof, the lateral body openings, and the pivot pieces will all advantageously be elongated. The outer portion of each of the pivot pieces will normally be frictionally engaged within the recess of the limb member with which it is associated, and raised rib formations may be provided thereon to enhance the level of frictional engagement within the limb member recesses.

The body of the toy figure will normally be elongated, with head and tail portions at the opposite ends thereof, and the push-button member will preferably be disposed and designed to represent part of the tail portion. In certain embodiments, the toy will additionally include a pair of fixed leg members symmetrically disposed on the rearward end of the body, to cooperate with the tail portion to provide three-point support for standing the toy on end.

BRIEF DESCRIPTION OF THE DRAWINGS

FIG. 1 is a perspective view of a toy creature figure embodying the present invention, shown with a humanoid companion;

FIG. 2 is a side elevational view, in partial section, of the toy figure of FIG. 1;

FIG. 3 is a plan view of a pivot piece which is employed for pivotably mounting a leg member of the toy;

FIG. 4 is a sectional view of the pivot piece of FIG. 3, taken along line 4—4 thereof;

FIG. 5 is a fragmentary plan view, in partial section, of the toy figure of FIGS. 1 and 2, drawn to a scale slightly enlarged therefrom;

FIG. 6 is a sectional view of the figure taken along line 6—6 of FIG. 5; and FIG. 7 is a sectional view of the toy, taken along line 7—7 of FIG. 5, showing two of the movable leg members on opposite sides of the body, together with the mounting and actuating parts, in their open (full line) and closed (phantom line) relationships.

DETAILED DESCRIPTION OF THE ILLUSTRATED EMBODIMENT

Turning now in detail to the appended drawings, FIG. 1 shows a toy creature figure embodying the present invention accompanying a companion humanoid figure, generally designated respectively by the numerals 10, 12. It will be understood that the science fiction motif for the figures illustrated, and the insect-like character of the creature toy, are non-limiting; the creature figure of the invention may of course take any of a wide diversity of forms.

The body of the toy creature figure is generally hollow, and consists of an upper and lower (or dorsal and ventral) section, generally designated respectively by the numerals 14, 16, which are joined to one another by appropriate means, such as ultrasonic welding, adhesive bonding, or the like; locating pins (unnumbered) and cooperating holes 18 (FIG. 5) may be provided to facilitate assembly, as is conventional. A head portion 20 is simulated at the forward end of the FIG. 10, and a tail portion 22 is simulated at the rearward end thereof.

The two sections 14, 16 cooperate to define lateral rectangular openings 24 along the opposite sides of the body, adjacent each of which is disposed a pivot piece, generally designated by the numeral 26. Upstanding rib elements 28 provide underlying support for the stub axles 30, which extend longitudinally from the ends of the body portion 32 of each pivot piece 26. They are retained by the rib elements 34, which are of similar form and depend from the upper section 14 in registry therewith; the rib elements 28, 34 have cooperating semi-circular recesses in their confronting ends to journal the axles 30 therebetween.

Extending outwardly along one side of each pivot piece 26 is a generally rectangular tang portion 36, which has a bead element 38 along its outer edge. An operating pin element 40 extends from the other side of the body portion 32 in the opposite direction, and peripheral wall elements 42 are formed on the top and bottom surfaces of the body portion 32.

An integrally formed, one-piece leg member, generally designated by the numeral 44, is mounted upon each of the pivot pieces 26, and provides three leg elements 46 along each side of the body 10; transversely aligned leg elements 46 are matched to one another to preserve the symmetry of the creature figure. Each leg member has an inner portion 48, within which is formed an elongated, compound recess 50 which extends into the portion 48 from along its inner edge surface. The body and tang portions of the pivot pieces 26 are inserted into the elongated recesses 50 of the associated leg members 44 to frictionally engaged them thereupon. As can best be seen in FIG. 7, the tang portion 36 and the body portion 32 are engaged, respectively, within relatively thin and relatively thick sections of the recess 50. The bead element 38 on the end of the tang portion, and the peripheral wall elements 42 on the opposite sides of the body portion, both serve to increase frictional engagement and thereby to enhance the level of security of the joint, while at the same time permitting ready removal of the leg members 44 from the supporting pivot pieces 26, if so desired.

An elongated actuating lever, generally designated by the numeral 52, is disposed within the body 10 along its longitudinal center line. The lever 52 is comprised of a coupling arm 54 and an operating arm 56, which extend in substantially opposite directions from the fulcrum. Trunnion elements 58 are provided thereat, and they are supported above and below by aligned rib elements 60, 62, which extend inwardly from the upper and lower body sections 14, 16, respectively. A coupling head, disposed at the outer end of the arm 54, is comprised of upper and lower elements 64, 66, which are both of a relatively flat V-shaped cross section and are apically disposed with respect to one another, as best seen in FIG. 7; they define a through slot 68, which extends longitudinally and tapers inwardly from both sides of the coupling arm 54, and is closed by an end wall element 70. The pin elements 40 of the two pivot pieces 26 extend into the resulting double V-shaped slot 68 from the opposite sides thereof, in substantial alignment with one another. It will be appreciated that the disposition of the coupling elements could be reversed if so desired, with the pin elements on the lever arm and the slot formations on the two pivot pieces. It will also be understood that the slot formations need not necessarily be rectilinear, and that they may be provided by grooves or the like.

The operating arm 56 of the lever 52 terminates in a small platform element 72, from the lower surface of which depends a locating lug 74. One end of a coil spring 76 is seated within a circular embossment 78 formed on the inner surface of the lower body section 16, and its opposite end receives the lug 74 and bears against the platform 72, to bias the coupling arm 54 in a downward (in the orientation of the toy illustrated) direction. A post 80 projects from the operating arm 56, at at point inwardly adjacent the platform element 72, through an opening 82 formed within the upper body section 14. The end of the post 80 is frictionally engaged within the bore 84 of a cylindrical formation 86 on the push-button member 88, to mount the member thereupon and within the body section opening 82; a peripheral lip element 90 extends about the base of the button member 88 and cooperates in retaining the parts in assembly.

Operation of the leg members 44, to simulate a gripping or strangling action of the creature, will be readily apparent. The normal (at rest) relationship of the movable parts is shown in all Figures depicting the toy, with the exception of the phantom line representation of FIG. 7. Manual force upon the push-button member 88 (conveniently achieved by grasping the tail portion 22 of the body between the thumb and forefinger) will depress the operating arm 56 of the actuating lever 52 against the bias of the coil spring 76, and will thereby elevate the coupling arm 54, which action will in turn be transmitted to both of the pivot pieces 26 through the pin elements 40 thereof. Specifically, the inner angled surfaces of the lower rectilinear element 66, defining the slot 68 in the head portion of the coupling arm 54, will contact the pin elements 40 to urge them upwardly, rotating the pivot pieces 36 in opposite directions, so as to simultaneously move the leg elements 46 of the two members 44 downwardly and inwardly toward one another (to the phantom line position of FIG. 7). Upon release of the button member 88, the angled surfaces of the upper rectilinear element 64 will contact the pin elements 40 to force them downwardly under the biasing force of the coil spring 76, and will thereby separate the leg elements of the two members 44 and return them to their normal relationship.

The toy creature figure also includes a pair of immovable rear leg elements 92. They are integrally formed as a single piece which includes a bridge element 94, and the body sections 14, 16 define relatively small lateral openings 96 within which the bridge element 94 is seated for convenient assembly. As will be noted from FIGS. 2, 5 and 6, the ends of the leg elements 92 are disposed substantially in a common plane with the generally rectilinear rear element 98 of the tail portion 22, which is formed on the lower body section 16. Consequently, the leg elements 92 and the tail portion 22 cooperate to provide a three-point supporting arrangement, enabling the creature figure to stand stably on end in an upright position.

The figure of the invention will normally be fabricated predominantly from synthetic resinous materials, and appropriate plastics will be evident to those skilled in the art; typically, materials such as ABS, PVC, and acetal resins will be employed. The variety of forms that the figure might take will also be self-evident.

Thus, it can be seen that the present invention provides a novel toy creature figure having a unique action feature in the form of matched appendages that move toward one another in a gripping motion. A unique mechanism is provided for operating the appendages, and the toy may have fixed appendages which cooperate with a tail portion to provide means for stably supporting it in an upright position. The toy creature figure of the invention is effective in its appearance and operation, is durable, and is relatively facile and inexpensive to manufacture.

Having described the invention, what is claimed is:

1. A free-standing toy figure having limbs capable of gripping action, comprising:

a generally hollow body having back, front and lateral portions with lateral openings formed therethrough;

a substantially matched, mirror-image pair of limb members, each having a mounting portion with a recess formed thereinto and a plurality of fixed appendages extending therefrom, said appendages of each of said limb members having free ends lying in a common plane and spaced from one another;

a pair of pivot pieces mounted within said body adjacent said lateral openings for pivotal movement about parallel axes, each of said pivot pieces having an outer mounting portion engaged within said recess of one of said limb members to mount said limb members thereupon with said appendages of both of said limb members extending in the same general direction;

an actuating member mounted within said body for pivotal movement about an axis generally transverse to said parallel axes, said actuating member having a portion disposed generally between said pivot pieces, and said member and pieces having interengaging means thereon for transmitting pivotal movement of said actuating member to said pivot pieces to effect pivotal movement thereof, said interengaging means comprising slot formations on either said actuating member or on both of said pivot pieces, and pin elements on the other of said actuating member and said both pivot pieces and disposed within said slot formations; means for biasing said limb members toward an open position of said appendages on one of said limb members relative to said appendages on the other one thereof, to permit said toy to be stably supported on said free ends thereof; and means on said body for enabling manual operation of said actuating member to simultaneously move said limb members to effect a closing, gripping action of said appendages on said one limb member relative to said appendages on said other one thereof.

2. The toy of claim 1 wherein said actuating member is in the form of a lever having a coupling arm extending from the fulcrum thereof between said pivot pieces, said coupling arm having said slot formations therein and comprising said interengaging means; and wherein said pin elements are disposed on said pivot pieces and project toward one another into said slot formations, said mounting portions of each of said pieces projecting outwardly therefrom.

3. The toy of claim 2 wherein said coupling arm of said lever has upper and lower rectilinear elements defining a slot therein, said rectilinear elements being of V-shaped, apically confronting cross sectional configuration to provide inwardly tapered slot formations extending along the opposite sides thereof.

4. The toy of claim 2 wherein said actuating lever also has an operating arm extending from said fulcrum in a direction generally opposite to said coupling arm.

5. The toy of claim 4 wherein said manual operation enabling means of said body comprises a push-button member accessible for finger contact and operatively to said operating arm of said lever to effect such simultaneous movement of said limb members through said pivot pieces.

6. The toy of claim 1 wherein said biasing means acts upon said actuating member.

7. The toy of claim 5 wherein said body is elongated and has a head portion and a tail portion at the opposite ends thereof, wherein said lever extends substantially on the longitudinal axis of said body, and wherein said push-button member comprises said tail portion thereof.

8. The toy of claim 1 wherein said appendages are of leg-like form and have said free ends thereof, on each of said limb members, spaced along a longitudinal axis of said body; and wherein said mounting portions and recesses thereof, said lateral body openings, and said pivot pieces and said outer portions thereof are all elongated in the longitudinal direction.

9. The toy of claim 8 wherein said outer portion of each of said pivot pieces is frictionally engaged within said recess of said limb member associated therewith.

10. The toy of claim 9 wherein said outer portion of each of said pivot pieces has raised rib formations thereon to enhance the level of frictional engagement within said limb member recesses.

11. The toy of claim 1 wherein said body is elongated and has a head portion and a tail portion at the opposite ends thereof, and wherein said toy additionally includes a pair of fixed leg members symmetrically disposed on said body adjacent said tail portion, said fixed leg members and tail portion cooperating to provide three-point support for standing said toy on end.

12. The toy of claim 11 wherein the free ends of said fixed leg members are disposed in said common plane.

* * * * *

UNITED STATES PATENT AND TRADEMARK OFFICE

CERTIFICATE OF CORRECTION

PATENT NO. : 4,666,419

DATED : May 19, 1987

INVENTOR(S) : Richard Droller et al

It is certified that error appears in the above—identified patent and that said Letters Patent is hereby corrected as shown below:

Column 6, line 46, insert -- connected -- after "operatively".

Signed and Sealed this

Twentieth Day of October, 1987

*Attest:*

DONALD J. QUIGG

*Attesting Officer*

*Commissioner of Patents and Trademarks*